US006039703A

United States Patent [19]

Badilla

[11] Patent Number: 6,039,703

[45] Date of Patent: Mar. 21, 2000

[54] DOUBLE-SIDED MASSAGER

[76] Inventor: Bernard Badilla, 551 Peralta Ave., San Francisco, Calif. 94110

[21] Appl. No.: 09/078,777

[22] Filed: May 14, 1998

[51] Int. Cl.[7] ..... A61H 23/02

[52] U.S. Cl. ..... 601/61; 601/111; 601/133; 601/134

[58] Field of Search ..... 601/28, 61, 40, 601/84, 95, 103, 108, 109, 110, 111, 133, 134, 135, 151, 152

[56] References Cited

U.S. PATENT DOCUMENTS

| | | |
|---|---|---|
| 2,148,661 | 2/1939 | Thierer . |
| 2,579,209 | 12/1951 | Smith . |
| 2,638,090 | 5/1953 | Nantz . |
| 3,933,151 | 1/1976 | Huie . |
| 5,167,225 | 12/1992 | Cheng-I . |
| 5,352,187 | 10/1994 | Tseng . |
| 5,405,311 | 4/1995 | Pecora et al. . |
| 5,484,390 | 1/1996 | Chiang . |
| 5,605,533 | 2/1997 | Badilla . |
| 5,681,266 | 10/1997 | Lin . |

*Primary Examiner*—Danton D. DeMille
*Attorney, Agent, or Firm*—Jack Lo

[57] ABSTRACT

A double-sided massager includes a housing with a slot sized for receiving a hand. Opposing sets of massaging members are arranged on the upper and lower sides of the slot for simultaneously massaging both sides of the hand. The massaging members are driven in a reciprocating up and down motion by crankshafts driven by a motor. One set of massaging members is attached to a movable carrier, which is adjustable so that the spacing between the opposing sets of massaging members can be varied for fitting hands of different thickness. In a second embodiment, the housing is wide enough for massaging both hands simultaneously. In a third embodiment, a pair of housings, each sized for receiving one hand, are hinged together for massaging the hands in a vertical position.

9 Claims, 2 Drawing Sheets

DOUBLE-SIDED MASSAGER

BACKGROUND OF THE INVENTION

1. Field of the Invention

This invention relates generally to massaging devices.

2. Prior Art

Devices for massaging a person's body are well known. Some are hand-held rollers or studded bars that are rubbed along parts of the body, and some are electrically powered to provide a vibratory motion. My U.S. Pat. No. 5,605,533 shows a foot massager with an array of reciprocating balls arranged on a housing for massaging only the bottom of a foot. No prior art massager can simultaneously massage both sides of a body part, such as a foot or a hand.

OBJECTS OF THE INVENTION

Accordingly, objects of the present massager are:

to simultaneously massage both sides of a hand;

to be adjustable for fitting hands of different thickness;

to massage the hand in a horizontal position or vertical position; and to massage both hands at the same time.

Further objects of the present invention will become apparent from a consideration of the drawings and ensuing description.

BRIEF SUMMARY OF THE INVENTION

A double-sided massager includes a housing with a slot sized for receiving a hand. Opposing sets of massaging members are arranged on the upper and lower sides of the slot for simultaneously massaging both sides of the hand. The massaging members are driven in a reciprocating up and down motion by crankshafts driven by a motor. One set of massaging members is attached to a movable carrier, which is adjustable so that the spacing between the opposing sets of massaging members can be varied for fitting hands of different thickness. In a second embodiment, the housing is wide enough for massaging both hands simultaneously. In a third embodiment, a pair of housings, each sized for receiving one hand, are hinged together for massaging the hands in a vertical position.

DRAWING REFERENCE NUMERALS

| | |
|---|---|
| 10. Housing | 11. Slot |
| 12. Hand | 13. Massaging Members |
| 14. Massaging Members | 15. Speed Control |

-continued

| | |
|---|---|
| 16. Housing | 17. Slot |
| 18. Hand | 19. Hand |
| 20. Housing | 21. Housing |
| 22. Hinge | 23. Hand |
| 24. Hand | 25. Slot |
| 26. Slot | 27. Carrier |
| 28. Adjusting Mechanism | 29. Knob |
| 30. Threaded Shaft | 31. Gear |
| 32. Transaxle | 33. Beveled Gears |
| 34. Gear Sleeves | 35. Threaded Shaft |
| 36. Guide | 37. Guide Slot |
| 38. Connecting Rod | 39. Crankshaft |
| 40. Gap | 41. Pin |
| 42. Crankshaft Portion | 43. Axis |
| 44. Motor | 45. Gears |
| 46. Floating Gear | 47. Output Shaft |
| 48. Crankshaft | 49. Gears |
| 50. Membrane | 51. Membrane |
| 52. Holes | 53. Spring |

DETAILED DESCRIPTION OF THE INVENTION

Figures 1, 2, 3:
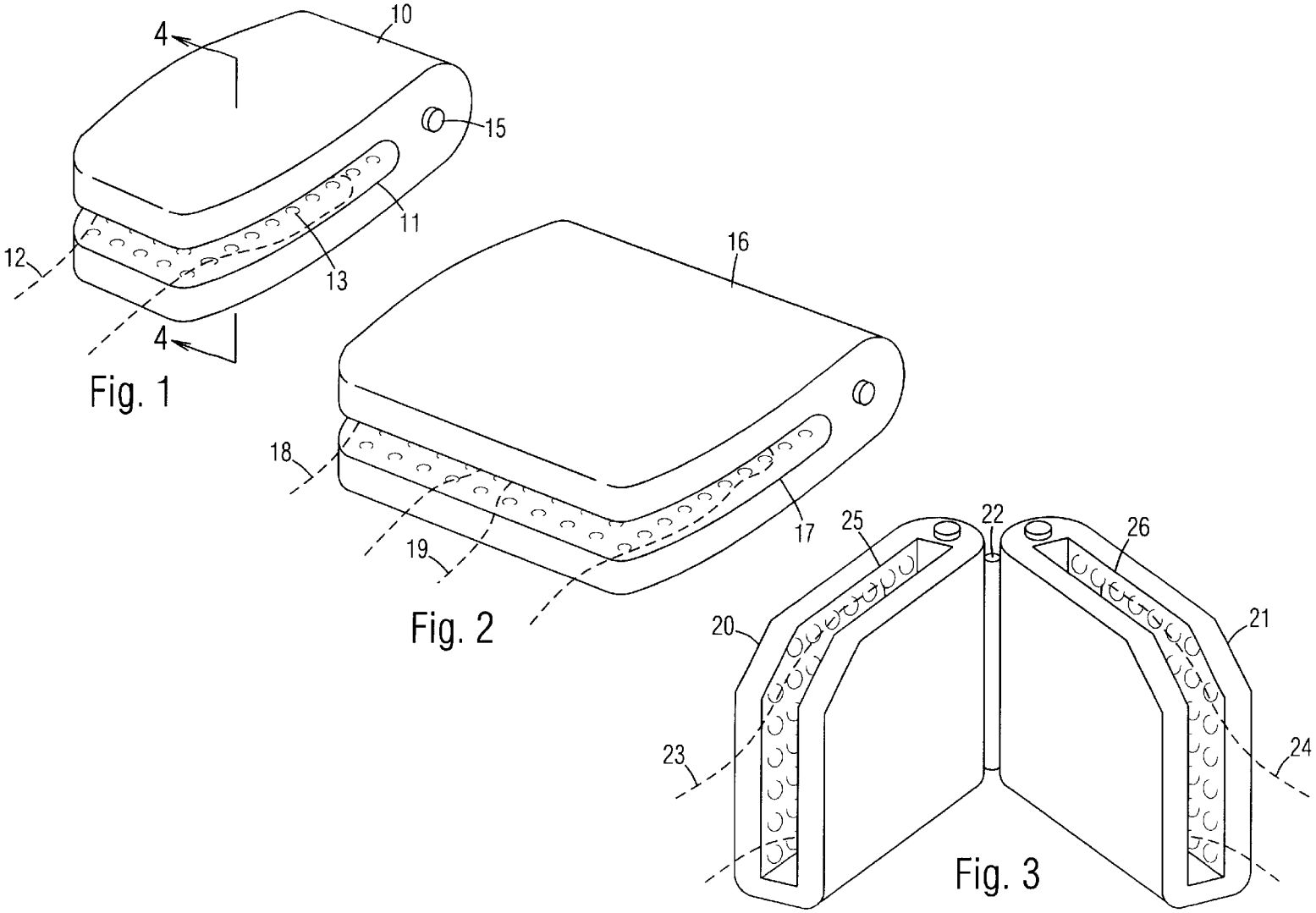
FIG. 1 is a front perspective view of a first embodiment of a double-sided massager.
FIG. 2 is a front perspective view of a second embodiment of the double-sided massager.
FIG. 3 is a front perspective view of a third embodiment of the double-sided massager.

FIGS. 1–3:

A first embodiment of a double-sided massager is shown in the front perspective view in FIG. 1. It includes a housing 10 with a slot 11 sized for receiving a single hand 12 with the fingers in an extended position. Opposing sets of massaging members 13 and 14 (FIG. 4) are respectively arranged on the lower and upper sides of slot 11 for simultaneously massaging both sides of the hand. Each set of massaging members is arranged in a plurality of rows that cooperate to form an array. A speed control 15 is arranged on a side of housing 10. A second embodiment of the massager shown in FIG. 2 includes a housing 16 and a slot 17 wide enough for receiving both hands 18 and 19 at the same time in a horizontal position. A third embodiment of the massager shown in FIG. 3 include two vertical housings 20 and 21 hinged together about a vertical axle 22 for receiving both hands 23 and 24 in vertical slots 25 and 26, respectively.

FIGS. 4–6:

In all embodiments, the massager includes the same internal mechanisms. The first embodiment of FIG. 1 is shown in a sectional view in FIG. 4 as an example. A non-adjustable set of massaging members 14 is attached to one side of slot 11, and an adjustable set of massaging members 13 is arranged on the opposite side of slot 11 for simultaneously massaging both sides of hand 12. Massaging members 13 are arranged on a carrier 27, which can be moved up and down with an adjusting mechanism 28 for adjusting the spacing between opposing massaging members 13 and 14 for fitting hands of different thickness.

Adjusting mechanism 28 preferably includes a knob 29 with a threaded shaft 30 extending into housing 10. A gear 31 meshing with shaft 30 is arranged around a transaxle 32. Beveled gears 33 are attached to opposite ends of transaxle 32, and are meshed with gear sleeves 34 which are pivoted on carrier 27. Gear sleeves 34 are screwed onto threaded shafts 35 fixedly attached to housing 10. Carrier 27 and massaging members 13 are thus adjusted toward or away from massaging members 14 by turning knob 29. A pair of guides 36 attached to housing 10 are movably positioned in guide slots 37 on carrier 27 to ensure its proper positioning.

Figures 4, 5, 6:
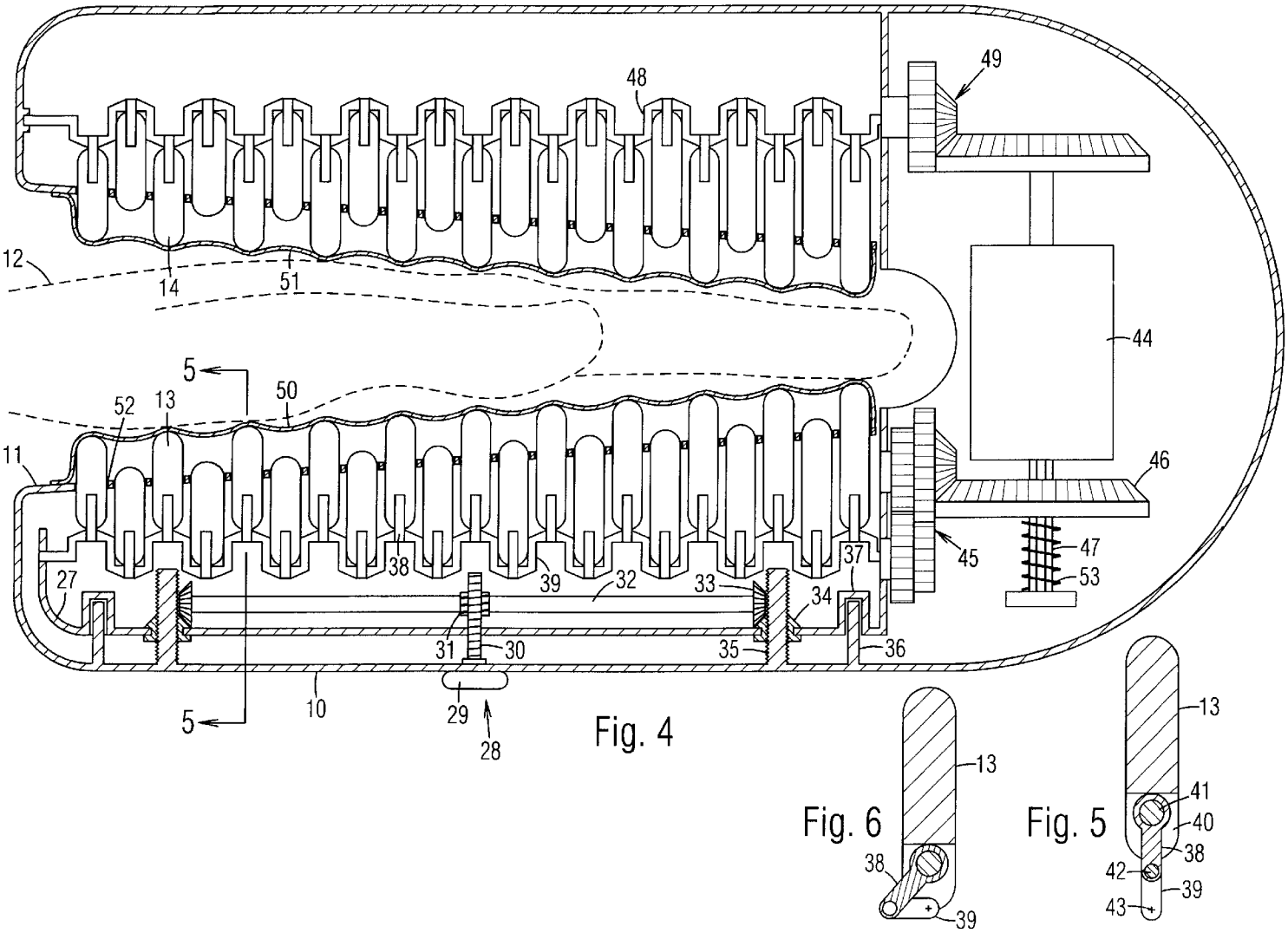
FIG. 4 is a sectional view of the double-sided massager, taken along line 4—4 in FIG. 1.
FIG. 5 is a sectional view of a massaging member and a crankshaft of FIG. 4.
FIG. 6 is a sectional view of the massaging member and the crankshaft in a rotated position.

The inner ends of massaging members 13 (one row shown) are connected by connecting rods 38 to a crankshaft 39 which is supported on carrier 27. As shown in the sectional view in FIG. 5, one end of connecting rod 38 is pivotally connected within a gap 40 on the lower end of massaging member 13 by a pin 41. Another end of connecting rod 38 is pivotally connected around a portion 42 of crankshaft 39 which is offset from its rotational axis 43. Massaging member 13 is driven in a reciprocating up and down motion by the rotation of crankshaft 39, as shown in FIG. 6. Massaging members 13 are positioned through holes 52 on a corresponding side of slot 11, so that they are restricted to linear motion, as shown in FIG. 4.

Crankshaft 39 is driven by a motor 44 through gears 45 and a floating gear 46 which is slidable along an output shaft 47 of motor 44. Shaft 47 is keyed to gear 46 to transmit rotary motion. Gear 46 is biased against gears 45 by a spring 53 positioned around shaft 47. Massaging members 14 are connected to a crankshaft 48 which is non-adjustably supported on the opposite side of slot 11, and driven by motor 44 through gears 49. Massaging members 13 and 14 are respectively covered by flexible membranes 50 and 51. Additional rows of massaging members 13 and 14 are likewise connected to additional crankshafts and driven by motor 44 by connected gears.

SUMMARY AND SCOPE

Accordingly, a double-sided massager is provided. It can simultaneously massage both sides of a hand. It is adjustable for fitting hands of different thickness. In different embodiments, it can massage a hand in a horizontal position or a vertical position, or massage both hands at the same time.

Although the above description is specific, it should not be considered as a limitation on the scope of the invention, but only as an example of the preferred embodiment. Many substitutes and variations are possible within the teachings of the invention. For example, the massaging members can be made to reciprocate up and down with other mechanisms, or arranged to move in other directions, such as from side to side, in circles, etc. Another adjusting mechanism may be provided for adjusting the massaging members within the housing. Instead of adjusting the massaging members within the housing, the entire housing may be adjustable in width for adjusting the spacing between the opposite sets of massaging members. The massager can be sized and shaped for massaging other parts of the body, such as the arms, legs, or feet. Therefore, the scope of the invention should be determined by the appended claims and their legal equivalents, not by the examples given.

I claim:

1. A double-sided massager, comprising:

a housing;

a slot extending into said housing for receiving a body part of a person;

a plurality of massaging members arranged on opposite sides of said slot for simultaneously massaging opposite sides of said body part; and an additional housing with an additional slot and additional massaging members for massaging an additional body part, said housing and said additional housing being hinged together and adjustable in angle relative to each other for enabling said person to position said body part at a comfortable angle relative to said additional body part.

2. A double-sided massager, comprising:

a housing;

a slot extending into said housing for receiving a body part of a person;

a plurality of crankshafts arranged in said housing on opposite sides of said slot;

a plurality of movable massaging members arranged on both of said sides of said slot;

a plurality of connecting rods connected between said crankshafts and said massaging members; and a motor driving said crankshafts and moving said massaging members in and out of said slot for simultaneously massaging opposite sides of said body part.

3. The double-sided massager of claim 2, wherein said slot is sized for receiving a pair of hands positioned side by side for simultaneously massaging both of said hands.

4. The double-sided massager of claim 2, further including an additional housing with an additional slot and additional massaging members for massaging an additional body part, said housing and said additional housing being hinged together and adjustable in angle relative to each other for enabling said person to position said body part at a comfortable angle relative to said additional body part.

5. The double-sided massager of claim 2, further including an adjusting mechanism connected between said carrier and said housing, said adjusting mechanism moving said carrier and thus said second set of massaging members relative to said first set of massaging members for engaging body parts of different sizes.

6. A double-sided massager, comprising:

a housing;

a slot extending into said housing for receiving a body part of a person, said slot having opposite internal sides;

a first set of massaging members arranged on one of said sides of said slot for massaging one side of said body part;

a second set of massaging members arranged on another one of said sides of said slot for simultaneously massaging an opposite side of said body part, said second set of massaging members being adjustable in distance relative to said first set of massaging members for engaging body parts of different sizes; and a motor with one output shaft connected to said first set of massaging members, and a second output shaft connected to said second set of massaging members through a floating gear movable linearly along said second output shaft, said floating gear moving along said second output shaft when said second set of massaging members is adjusted in distance relative to said first set of massaging members, thereby power from said motor is transmitted to said second set of massaging members through said floating gear, regardless of the distance between said first set of massaging members and said second set of massaging members.

7. The double-sided massager of claim 6, wherein said slot is sized for receiving a pair of hands positioned side by side for simultaneously massaging both of said hands.

8. The double-sided massager of claim 6, further including an additional housing with an additional slot and additional massaging members for massaging an additional body part, said housing and said additional housing being hinged together and adjustable in angle relative to each other for enabling said person to position said body part at a comfortable angle relative to said additional body part.

9. The double-sided massager of claim 6, further including an adjusting mechanism connected between said second set of massaging members said housing, said adjusting mechanism moving said second set of massaging members relative to said first set of massaging members for engaging body parts of different sizes.

* * * * *